US005213265A

United States Patent [19]

Englhard et al.

[11] Patent Number: 5,213,265

[45] Date of Patent: * May 25, 1993

[54] SINGLE VALVE ASPIRATION TYPE SPRAYER

[75] Inventors: Ronald F. Englhard, Mission Viejo; Donald J. Shanklin, Fullerton, both of Calif.

[73] Assignee: Hayes Products L.P., Santa Fe Springs, Calif.

[ * ] Notice: The portion of the term of this patent subsequent to Mar. 31, 2009 has been disclaimed.

[21] Appl. No.: 848,301

[22] Filed: Mar. 9, 1992

Related U.S. Application Data

[63] Continuation-in-part of Ser. No. 671,259, Mar. 18, 1991, Pat. No. 5,100,059.

[51] Int. Cl.[5] ..... B05B 7/26; B05B 7/30

[52] U.S. Cl. ..... 239/310; 239/318; 222/484

[58] Field of Search ..... 239/310, 318, 414; 222/630, 637, 129.2, 484

[56] References Cited

U.S. PATENT DOCUMENTS

| | | | |
|---|---|---|---|
| 3,186,643 | 1/1965 | George et al. | 239/318 |
| 3,770,205 | 11/1973 | Proctor et al. | 239/318 |
| 4,583,688 | 4/1986 | Crasper | 239/318 |
| 4,653,691 | 3/1987 | Grime | 239/318 |
| 4,750,674 | 6/1988 | Chow et al. | 239/318 |
| 4,767,058 | 8/1988 | La Rosa et al. | 239/318 |
| 5,007,588 | 4/1991 | Chow et al. | 239/310 |

*Primary Examiner*—Andres Kashnikow
*Assistant Examiner*—Lesley D. Morris
*Attorney, Agent, or Firm*—Harold L. Jackson

[57] ABSTRACT

An aspiration type chemical sprayer for dispensing small quantities of a liquid based chemical into a stream of carrier fluid is disclosed. The sprayer includes a sprayer head assembly sealingly mounted onto a container holding chemicals such as pesticides or fertilizers. A unitary valve in the sprayer head assembly controls carrier fluid flow from a pressurized source of water while simultaneously providing a controlled aspiration rate and full communication of the container interior to atmospheric pressure. The valve additionally includes simultaneously closure of the carrier fluid, aspiration and vent passageways so as to seal the chemical in the container when the sprayer is not being used.

15 Claims, 4 Drawing Sheets

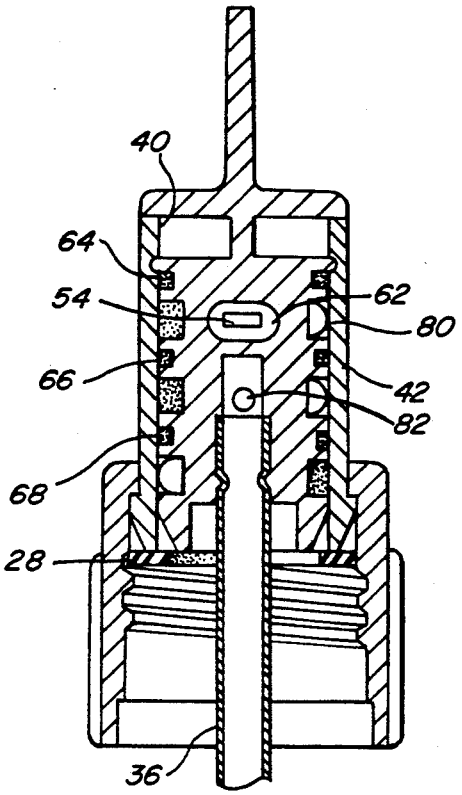
FIG. 6
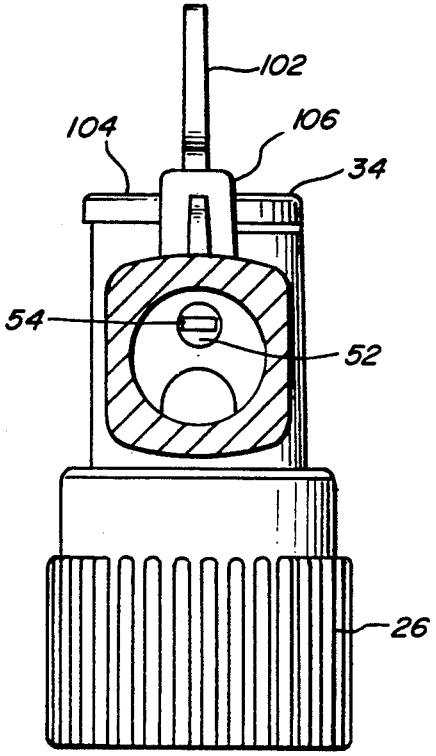
FIG. 7
FIG. 8
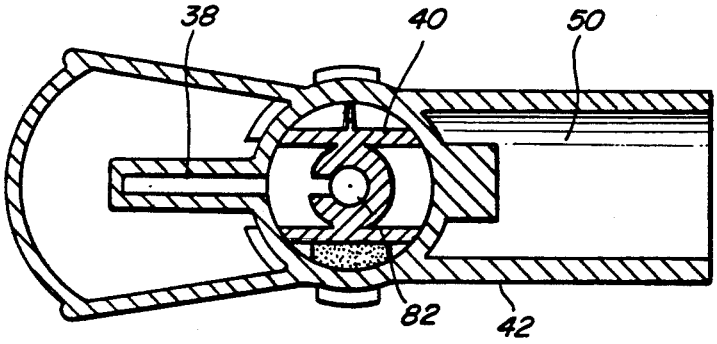
FIG. 9
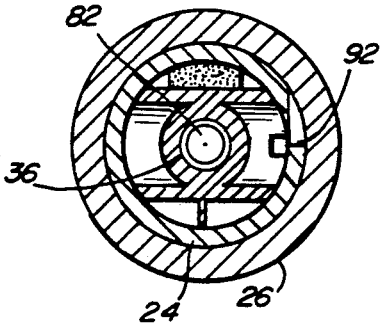

SINGLE VALVE ASPIRATION TYPE SPRAYER

BACKGROUND OF THE INVENTION

1. RELATED APPLICATION

This application is a continuation-in-part of application Ser. No. 07/671,259 filed Mar. 18, 1991, now U.S. Pat. No. 5,100,059 and assigned to the assignee of this application.

2. FIELD OF THE INVENTION

The invention relates generally to mixing and dispensing sprayers and more particularly to an aspiration type sprayer for use in dispensing small quantities of a liquid based chemical into a relatively large quantity of a carrier fluid.

3. DESCRIPTION OF RELATED ART

Every year thousands of gallons of chemicals such as fertilizers or pesticides are applied to crops, plants, lawns, flowers, vegetable gardens and other organic type vegetation. Such chemicals are sold to the consumer in concentrated form and therefore are extremely hazardous to the consumer end user and environment in general. Accordingly, these hazardous chemicals preferably are marketed in containers with a sprayer head permanently attached thereto so as to minimize accidental exposure to the consumer, such as from careless handling. Furthermore, a tamper proof container arrangement is needed to prevent unauthorized access by children whose curiosity sometimes gets the better of them. To make such nonrefillable products economically feasible, it is necessary to provide a sprayer which is of sufficiently low cost to allow the bottle and sprayer arrangement to be discarded when the container contents have been all used up. In order to be commercially accepted such a sprayer must be inexpensive to manufacture and yet operate reliably and safely provide a desired mixing ratio to meet the particular requirements of the individual user.

Several aspiration type sprayers have evolved over the years, but have met with certain disadvantages that make them undesirable. For example, U.S. Pat. No. 4,750,674 issued to Chow et al., discloses a sprayer having a system of air vent and aspiration openings of different sizes to obtain a selection of discrete mixing ratios. The mechanism requires a system of cups to block openings associated with nonselected aspiration rates and to provide the desired fluid communication. Such a system, however, requires the alignment and assembly of a plurality of elements including openings, cup seal and springs. Such a system is complicated to manufacture and assemble and therefore is undesirably expensive. Further, such devices fail to provide a simplified sprayer with a minimum of parts that are of simple design to promote reliability.

Other conventional sprayers, such as that described in U.S. Pat. No. 3,186,643 issued to George et al. use a rotating carrier fluid valve having a range of adjustability of carrier fluid flow in combination with a vent bore closure boss extending from the rotating valve. George et al.'s sprayer arrangement, however, like other conventional sprayers disadvantageously has many parts which makes it an undesirable alternative for a low cost disposable type sprayer.

An improved aspiration-type sprayer is disclosed in a co-pending patent application Ser. No. 468,845, filed Jan. 23, 1990, now U.S. Pat. No. 5,100,059, for Aspiration-Type Chemical Sprayer also assigned to the assignee of the present invention which includes a sprayer head assembly sealingly mounted onto a container for storing a chemical to be dispensed. The sprayer head includes a multi-function unitary valve providing an aspiration opening simultaneously with full communication of the container interior to atmospheric pressure. The valve may include means for positive and simultaneous closure of the aspiration and vent passages so as to seal the chemical in the container when the sprayer is not in use. The sprayer assembly is coupled to a source of pressurized carrier fluid such as a garden hose. The carrier fluid is controlled by a control valve which blocks the flow of water from the hose when the sprayer is not in use. While this sprayer is of simple construction, two valves typically are employed. It would be an advancement to the art to have a sprayer arrangement that includes only one valve to control aspiration, venting and carrier fluid flow in a simple yet reliable construction.

SUMMARY OF THE INVENTION

It is therefore an object of the invention to provide an aspiration-type chemical sprayer which includes a minimum number of components that are relatively easy to manufacture and assemble.

It is another object of the invention to provide an aspiration-type chemical sprayer with a unitary multifunction valve controlling aspiration, venting and carrier fluid flow.

It is an advantage of the invention that the single valve aspiration-type chemical sprayer can be held by one hand while simultaneously being operated by the other hand.

A single valve aspiration type sprayer, according to the present invention, includes a sprayer head assembly that is attached to a container for storing chemicals therein. A hose may be connected to the sprayer head assembly to provide the necessary carrier fluid, which typically is water. The sprayer head assembly has a valve rotatably positioned therein simultaneously intersecting three passageways: an aspiration passageway, a vent passageway and a carrier fluid passageway. In closed position, the three passageways are blocked by the valve. However, in the open position, the valve has formed integrally therethrough three holes which provide simultaneous registry for the aspiration passageway, vent passageway and carrier fluid passageway.

Other and further objects, advantages and characteristic features of the present invention will become readily apparent from the following detailed description of a preferred embodiment of the invention when taken in conjunction with the accompanying drawings.

BRIEF DESCRIPTION OF THE DRAWINGS

FIG. 6 is a sectional view taken along line 6—6 of FIG. 4;

FIG. 7 is a sectional view taken along line 7—7 of FIG. 1;

FIG. 8 is a sectional view taken along line 8—8 of FIG. 4;

FIG. 9 is a sectional view taken along line 9—9 of FIG. 4;

DESCRIPTION OF THE PREFERRED EMBODIMENTS

Figure 3:
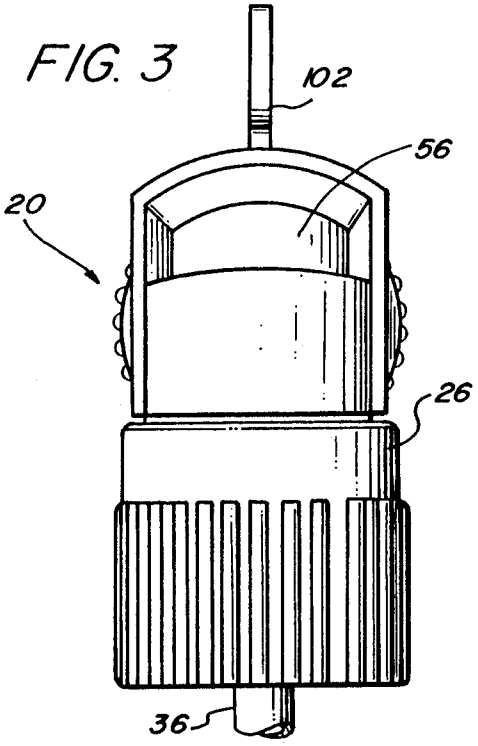
FIG. 3 is a front elevational view of the sprayer head assembly of FIG. 2.
Figure 2:
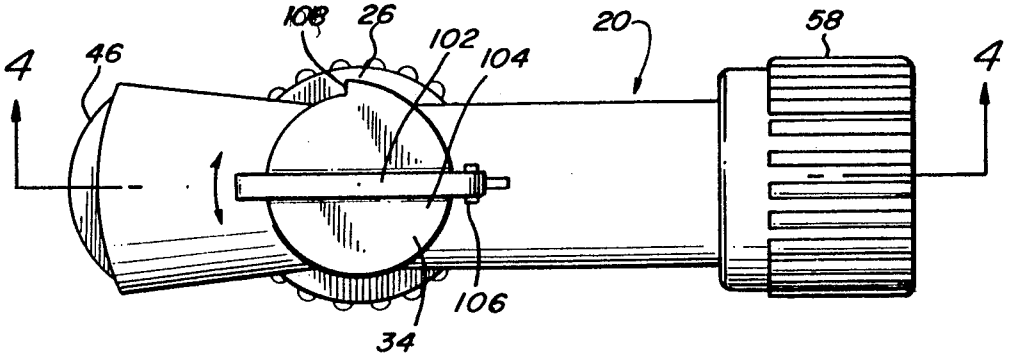
FIG. 2 is a top view of the sprayer head assembly of FIG. 1.
Figure 1:
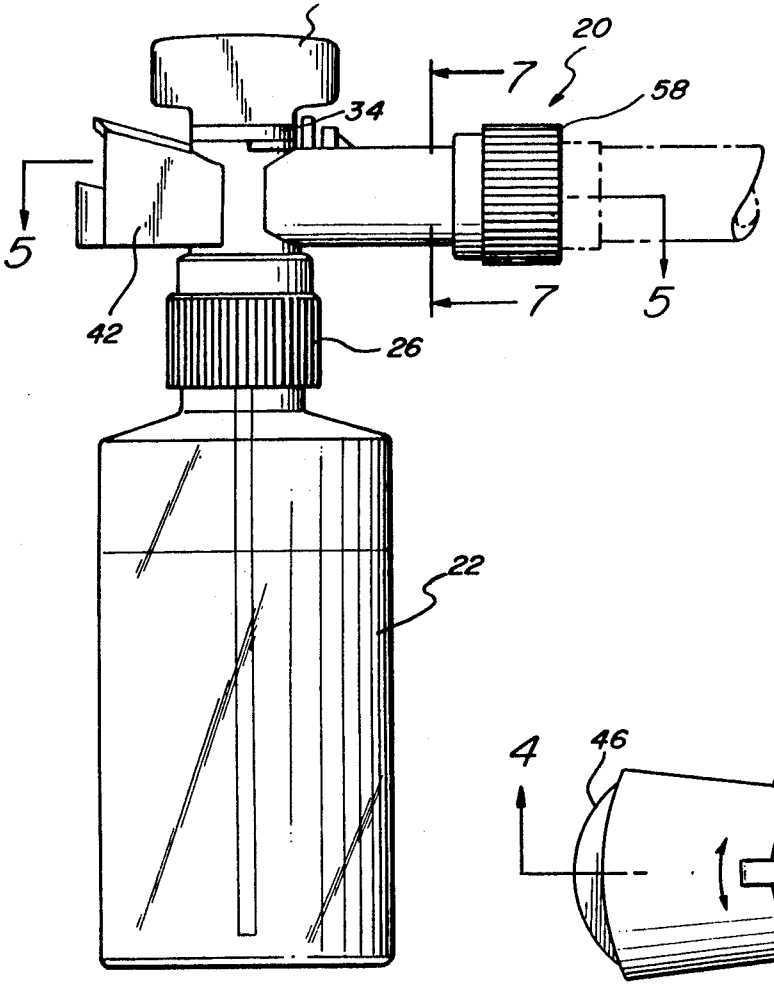
FIG. 1 is a side elevational view of a sprayer head assembly according to the principles of the invention.

Referring now with more particularity to the drawings, wherein like or similar parts are designated by the same numerals throughout the various figures, a sprayer head assembly 20 is illustrated in FIGS. 1–4 which sealingly is secured to the mouth of a chemical container 22. The connection between the sprayer head assembly 20 and container 22 can be achieved by providing the depending sprayer neck portion 24 with a conventional rotatable coupler 26 including washer 28, the rotatable coupler having internal threads which cooperatively receive corresponding threads surrounding the mouth of a container bottle, such as container 22. To make the sprayer head assembly 20 non-removable from the container neck, the sprayer neck may include inwardly projecting lugs which oppose cooperating lugs (now shown) formed on the container, thereby preventing removal of the sprayer head assembly following installation onto a chemically filled container. When installed to the sprayer head assembly 20, the mouth of container 22 is in communication with upstream aspiration duct 30 and upstream vent duct 32 and opening 33 in rotatable valve 34 and otherwise closed upper interior of neck, see also FIGS. 6 and 8–9. The vent duct 32 is formed by a slot in the lower end of the valve body and the inner surface of a cylindrical bore 40. The aspiration duct 30 communicates with a downwardly depending chemical flow or dip tube 36 which extends into container 22 terminating proximate the bottom thereof. A downstream aspiration passageway 38 formed in sprayer head 42 also communicates with the interior of cylindrical bore 40. The downstream aspiration passageway 38 communicates with aspiration orifice 43 which terminates into graduated recess 44 formed on upwardly inclined wall 46 of sprayer head 42.

The sprayer head assembly 20 includes an inlet fluid carrier means which comprises an input chamber 50 and first constricted fluid carrier hole 52, second constricted carrier fluid hole 54, and hooded or expansion chamber 56 serving as the outlet. The upstream end of inlet fluid carrier means includes a conventional rotatable coupler 58 including washer 60, for threaded sealing engagement between input chamber 50 and a source of pressurized carrier fluid, such as a garden hose (not shown), for example. The carrier fluid is received in input chamber 50 and controlled through first constricted hole 52 by means of rotatable valve 34 which has a carrier fluid duct 62 traversely therethrough. The rotatable valve 34 may be rotated to align carrier fluid duct 62 with first and second constricted holes 52 and 54 for discharge of carrier fluid into hooded chamber 56. Second constricted hole 54 preferably has an elongated rectangular cross-sectional shape as shown more particularly in FIGS. 6 and 7, which aids in spreading the carrier fluid as it enters the hooded chamber 56.

Figure 4:
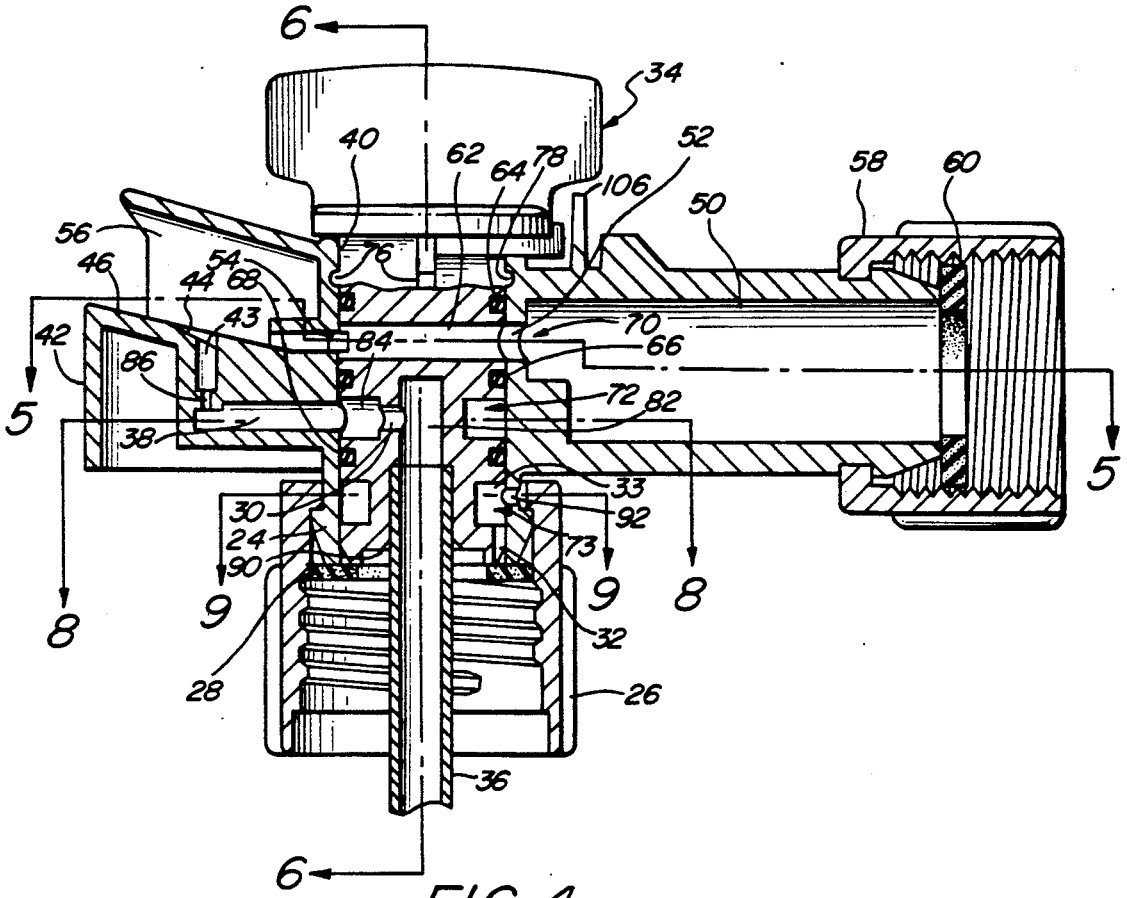
FIG. 4 is a sectional view taken along line 4—4 of FIG. 2.
Figure 5:
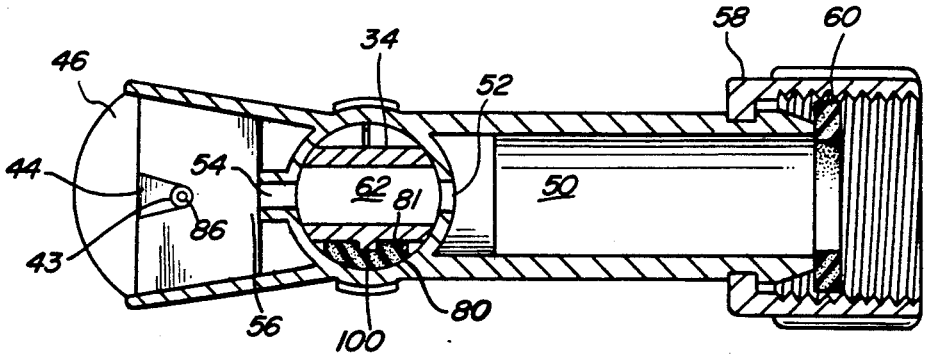
FIG. 5 is a sectional view taken along line 5—5 of FIG. 4.
Figure 10:
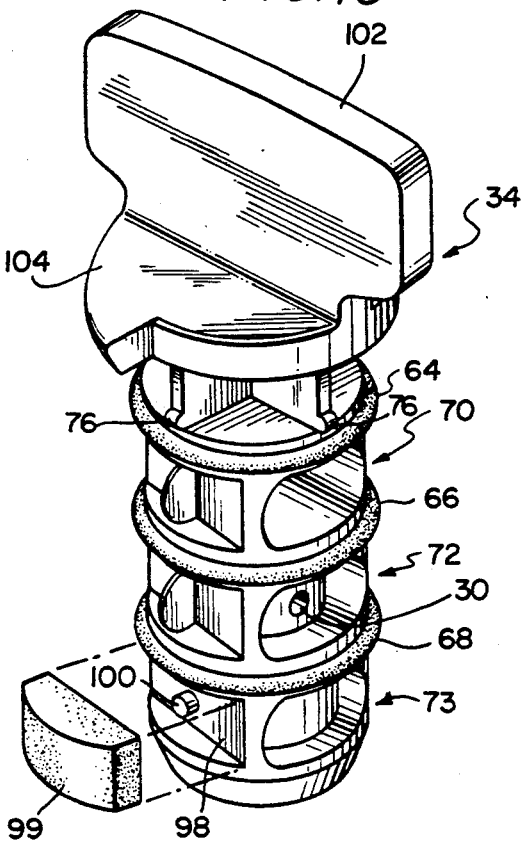
FIG. 10 is a perspective view of a control valve according to the principles of the invention.
Figure 11:
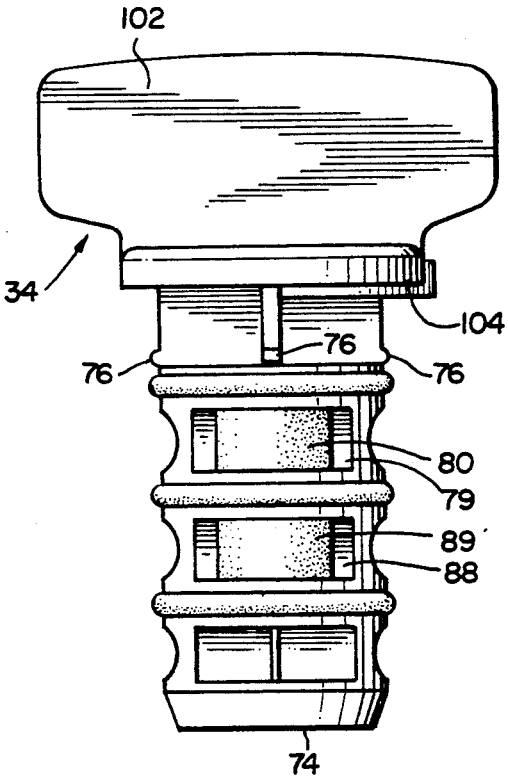
FIG. 11 is an elevational view of the control valve of FIG. 10.
Figure 12:
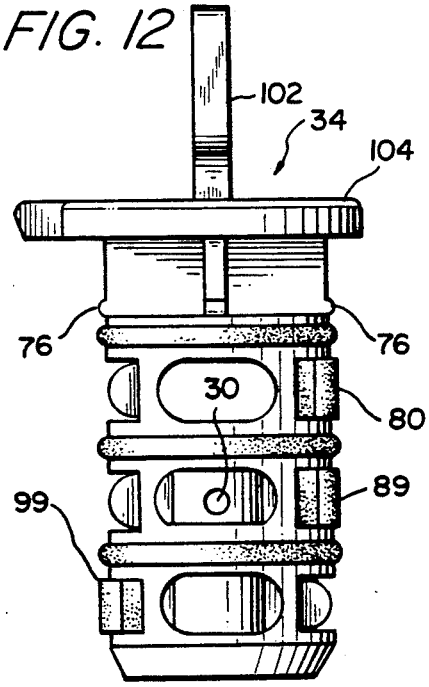
FIG. 12 is another elevational view from a different side of the control valve of FIG. 10.
Figure 13:
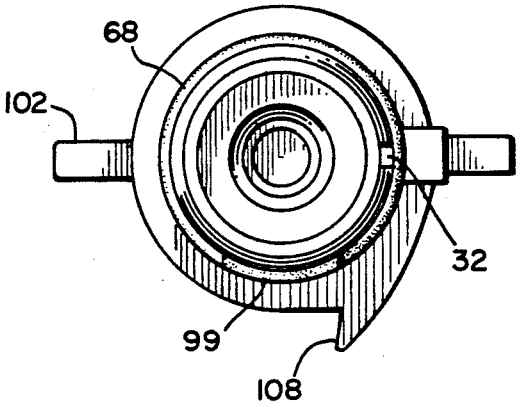
FIG. 13 is a bottom view of the aspiration control valve of FIG. 10.

Rotatable valve 34 also controls communication of vent duct 32 with atmospheric pressure and communication of downstream aspiration passageway 38 with the contents of the chemical container via chemical flow tube 36 as shown in FIGS. 4–9. Valve 34 is constructed to define a cylindrical periphery for sliding engagement with the interior wall of bore 40. The valve outer periphery is divided by O-rings 64, 66, 68 shown in FIG. 10 which rest in circumferential grooves as shown in FIGS. 11 and 12. The O-rings divided the valve into a carrier fluid control segment 70, an aspiration control segment 72 and a vent control segment 73. The valve 34 is inserted into bore 40 so as to position the valve end 74 adjacent the washer 28 and open neck portion of container 22. Radial projections 76 at the top of valve 34 (FIG. 10) snap into an annular groove 78 circumscribing the inner wall of bore 40 (FIG. 4). The length of valve 34 is selected and oriented so that when the projections 76 are snapped into the annular groove 78, the valve 34 is functionally aligned relative to the carrier fluid constructed holes 52 and 54, and downstream aspiration passageway 38. The O-rings 64, 66, 68 engage the cylindrical wall of bore 40 so as to sealingly partition the carrier fluid control segment 70 within the bore and also sealingly partition the aspiration and vent segment 72 within the bore. The carrier fluid segment has formed therein a recessed area 79 which retains a first stopper member 80 (FIG. 11). Stopper member 80 sealingly engages the cylindrical wall of bore 40 as shown more particularly in FIG. 5, and when it is in registry with the second constricted passageway 54 by rotating valve 34 to its closed position, carrier fluid flow is prevented.

The aspiration segment 72 defines therein the aspiration duct 30 which includes a downwardly extending upstream section 82 which communicates with the container via the chemical flow tube 36, and a traverse downstream section 84 which opens into the outer peripheral surface of valve 34 (FIG. 4). When the traverse downstream section 84 of valve 34 is in registry with downstream aspiration passageway 38 in sprayer head 42, communication of the contents of container is possible at a flow rate which is controlled by constricted aspiration opening 86 and the carrier fluid pressure. The size of constricted opening 86 is preselected based on typical carrier fluid pressures to yield a desired mixing ratio of chemical to carrier fluid. The aspiration segment 72 has formed therein a recessed area 88 which contains a second stopper member 89 which sealingly engages the cylindrical wall of the bore 40 when it is in registry with the aspiration passageway 38 by rotating the valve 34 to its closed position (FIG. 11).

The vent segment 73 defines therein the vent duct 32 which communicates via opening 33 with counterbore 90 in the lower end of valve 34 and thereby the interior of the container 22. Vent duct 32 also communicates with transverse atmospheric vent port or passageway 92 in the downwardly depending sprayer neck portion 24 providing communication of the interior of container 22 with the atmosphere. The vent duct 32 (like the carrier fluid and aspiration duct) has formed therein a recessed area 98 which contains a third stopper member 99 which sealingly engages the cylindrical wall of the bore 40 when it is in registration with the vent passageway 92 (FIG. 10). Communication of atmospheric pressure with the interior of container 22 is prevented by the engagement of the third stopper member 99 with the cylindrical wall of bore 40 when valve 34 is in a closed position.

It should be noted that the stopper members are preferably made of a suitable plastic which will deform a slight amount under a compressive load to thereby provide a fluid tight seal with the interior wall of the bore 40 which typically is made of a harder plastic material. The stopper members have an arcuate external surface with the same radius of curvature as the bore 40. The stopper members are provided with a centrally located cylindrical recess (not shown) on the inside thereof which slidably engages a cylindrical stub 100 within the respective recess in the valve body 34 as is illustrated with respect to stopper 99 in FIG. 10. When the valve is in its closed position, fluid under pressure within the segments 70, 72 and 73 acting on the inner surfaces of the stopper member force the members radially outwardly against the wall of the bore surrounding the associated hole or passageway in the valve body to maintain a tight seal. For example, when the valve is in its closed position, water under pressure acts on the inner surface 81 of the stopper member 80 (FIG. 5) and forces the stopper member against the wall of the bore 40 surrounding the orifice 54 to maintain a liquid tight seal.

The valve 34 is configured to provide full communication of vent duct 32 to atmospheric pressure through depending neck portion axial atmospheric vent port 92 simultaneously with registry of aspiration duct 30 with downstream aspiration passageway 38 simultaneously with registry of carrier fluid duct 62 with constricted holes 52 and 54.

In operation, when the valve 34 is rotated in the open position by turning wing 102 on valve cap 104, a stream of pressurized fluid is discharged through the second constricted hole 54 into the hooded or expansion chamber 56 resulting in a zone of reduced pressure outside the graduated recess 44. As shown in FIG. 4, if the valve is open, the suction created by the low pressure in expansion chamber draws the chemical solution in the container through chemical flow tube 36, aspiration passageways 82, 84, 86 and 43 and into the stream of the carrier fluid. Venting is provided through vent duct 32 and atmospheric vent port 92. The sprayer nozzle valve arrangement can conveniently be operated with one hand while the sprayer nozzle, chemical container and water hose can be controlled with the other thereby providing a safe spray operation. A tab 108 on valve cap 104 locks behind upwardly extending tab 106 securing valve 34 in a closed position when the sprayer is not in use.

Although the dispensing closure may be made of any suitable material, flexible synthetic plastic material is preferred such as polyethylene which is particularly suitable for constructing the sprayer head assembly 20 since it is resilient yet durable. However, any other material which is resistant to and compatible with the chemical fluid to be sprayed or other matter to be held in the container may also be used as a material for manufacturing the sprayer head assembly.

The above described detailed description of a preferred embodiment described the best mode contemplated by the inventors for carrying out the present invention at the time this application was filed and is offered by way of example and not by way of limitation. Accordingly, various modifications may be made to the above-described preferred embodiment without departing from the scope of the invention. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What is claimed is:

1. An aspiration-type chemical sprayer, comprising:

a container having an interior for storing a chemical to be sprayed;

a sprayer head assembly having an interior surface defining a bore and further having an outlet means and an inlet carrier fluid passageway means for directing a pressurized flow of carrier fluid into said outlet means;

connection means for mounting said sprayer head to said container;

said sprayer head assembly further defining an aspiration passageway for communication between said container interior and said outlet means and a vent port for communication of atmospheric pressure with said container interior;

a valve movably positioned within said bore in the sprayer head assembly so as to simultaneously intersect said inlet passageway, aspiration passageway and said vent port;

said valve having integrally formed thereto inlet carrier fluid duct channeling means, aspiration duct channeling means and vent duct channeling means, for controlling simultaneous communication through said inlet passageway means, aspiration and vent passageways when said valve is in an open position; and said valve further having inlet passageway closure means, aspiration passageway closure means and vent passageway closure means for providing simultaneous closing of said passageways when said valve is in a closed position, said closure means comprising a stopper member on said valve associated with each of the inlet, aspiration and vent passageways for sealing engagement with the bore surface when said valve is positioned in a closed position.

2. The apparatus defined in claim 1 wherein said connection means comprises a rotatable coupler which sealably mounts the sprayer head to said container.

3. The apparatus defined in claim 2 wherein said valve is rotatably positioned within said bore.

4. The apparatus defined in claim 3 wherein said bore aspiration passageway includes a constricted passageway of predetermined size for controlling flow of a chemical stored in said container.

5. The apparatus defined in claim 4 wherein said valve and bore include locating means for positioning said valve within said bore.

6. The apparatus defined in claim 5 wherein said valve includes three O-rings positioned to sealingly partition each of said inlet aspiration and vent passageways from each other.

7. The apparatus of claim 1 wherein each stopper member has an arcuate outer surface of approximately the same radius as the radius of the bore in the sprayer head assembly.

8. The apparatus of claim 7 wherein each stopper member is free to move radially outwardly against the interior wall of the bore.

9. The apparatus of claim 8 wherein the stopper members are deformable under a compressive load to provide a tight seal against the wall of the bore when the valve is in its closed position.

10. The apparatus of claim 6 wherein both the sprayer head assembly and the stopper members are made of a plastic material, the plastic material for the stopper members having a greater hardness then the plastic material for the sprayer head assembly.

11. An aspiration-type chemical sprayer comprising:

a container having an interior for storing a chemical to be sprayed;

a sprayer head having an internal bore, an expansion chamber, a carrier fluid inlet chamber for directing a pressurized flow of carrier liquid into the expansion chamber, an aspiration passageway for directing chemicals from the container interior to the expansion chamber and an atmospheric vent port for communication of atmospheric pressure with the container interior;

connection means for mounting the sprayer head to the container;

a chemical flow tube in fluid communication with the chemical stored in the container; and a valve member rotatably positioned within the bore in the sprayer head and having formed integrally therein:

a) a carrier fluid duct for connecting the carrier fluid inlet chamber to the expansion chamber;

b) an aspiration duct for connecting the chemical flow tube to the aspiration passageway;

c) an atmospheric duct for connecting the vent port to the interior of the container in one open position and to simultaneously disconnect;

d) the carrier fluid inlet chamber from the expansion chamber;

e) the chemical flow tube from the aspiration passageway;

f) the vent port from the interior of the container in another closed position; and g) the valve member further including a stopper member individually associated with each of the ducts in the valve member for sealingly engaging the surface of the bore in the sprayer head for preventing the flow of carrier fluid and chemical into the expansion chamber and the flow of chemical through the vent port when the valve is in the closed position.

12. The apparatus of claim 11 wherein each stopper member has an arcuate outer surface of approximately the same radius as the radius of the bore in the sprayer head assembly.

13. The apparatus of claim 12 wherein each stopper member is free to move radially outwardly against the interior wall of the bore.

14. The apparatus of claim 13 wherein the stopper members are deformable under a compressive load to provide a tight seal against the wall of the bore when the valve is in its closed position.

15. The apparatus of claim 14 wherein both the sprayer head assembly and the stopper members are made of a plastic material, the plastic material for the stopper members having a greater hardness then the plastic material for the sprayer head assembly.

* * * * *